United States Patent [19]

Weiss et al.

[11] Patent Number: 4,509,033

[45] Date of Patent: Apr. 2, 1985

[54] IGNITION COIL CONSTRUCTION FOR ENGINE IGNITION SYSTEM

[75] Inventors: Günther Weiss, Markgröingen; Paul Wörz; Stanislaus Tomczak, both of Schwieberdingen, all of Fed. Rep. of Germany

[73] Assignee: Robert Bosch GmbH, Stuttgart, Fed. Rep. of Germany

[21] Appl. No.: 493,961

[22] Filed: May 12, 1983

[30] Foreign Application Priority Data

May 12, 1982 [DE] Fed. Rep. of Germany ..... 3217754
Mar. 19, 1983 [DE] Fed. Rep. of Germany ..... 3309986

[51] Int. Cl.[3] ..... H01F 27/04

[52] U.S. Cl. ..... 336/107; 336/96; 336/198; 336/DIG. 2

[58] Field of Search ..... 336/107, 96, 198, 208, 336/DIG. 2

[56] References Cited

U.S. PATENT DOCUMENTS

| | | | |
|---|---|---|---|
| 2,414,692 | 1/1947 | Harkness et al. | 336/107 X |
| 2,483,815 | 10/1949 | Easton | 336/DIG. 2 |
| 2,531,638 | 11/1950 | Miller | 336/107 X |
| 3,743,989 | 7/1973 | Nicolas et al. | 336/DIG. 2 |
| 4,161,776 | 7/1979 | Onoue | 336/107 X |

FOREIGN PATENT DOCUMENTS

| | | | |
|---|---|---|---|
| 122424 | 10/1946 | Australia | 336/107 |

*Primary Examiner*—A. D. Pellinen
*Assistant Examiner*—Susan Steward
*Attorney, Agent, or Firm*—Frishauf, Holtz, Goodman & Woodward

[57] ABSTRACT

The primary coil body (10) with its coil, the secondary coil body (11) with its coil and also the high voltage connector body (12) with a connector (13) therein are separate bodies put together by snap connections to provide a pre-assembled unit. A dual connector for the primary coil ends may also be provided as a separate part snap-connected to the primary coil body. The center leg of an E-shaped core part passes through the primary coil body, the latter having a cross extension on which a straight core member fits passing across the ends of the legs of the E part. After perfecting electrical contacts by soldering or welding, this unit is inserted into a single-use mold and is embedded in an insulating casting resin by injection molding. As a result of the snap-type fitting together of the coil bodies and the high voltage connector, as well as the low voltage connector body similarly fastened onto the primary coil body, it is possible to use a one-piece single-use mold for the injection molding operation.

17 Claims, 7 Drawing Figures

FIG. 1
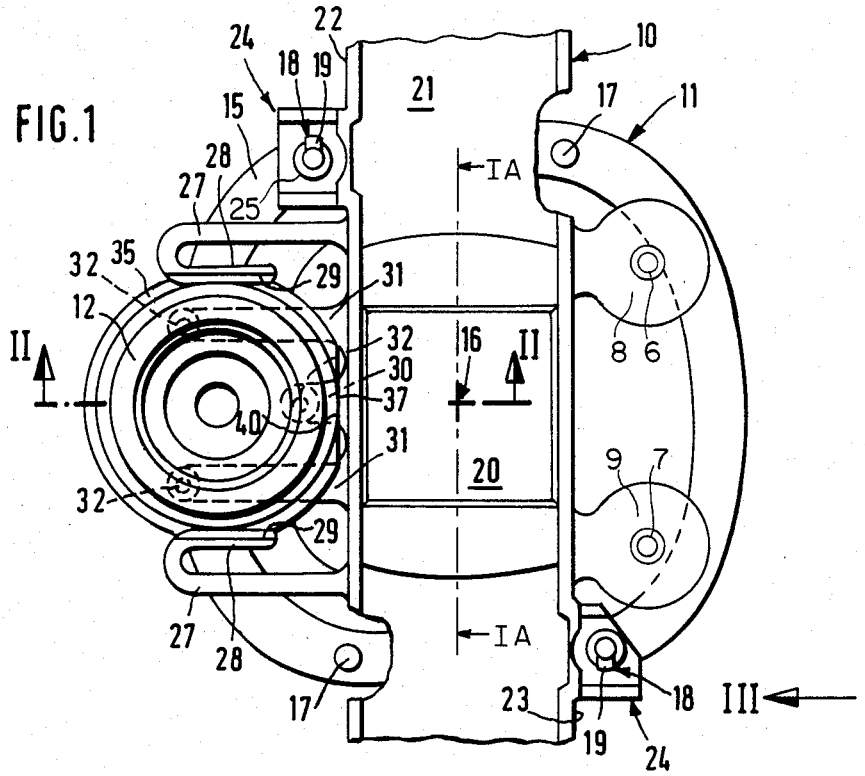
FIG. 1A
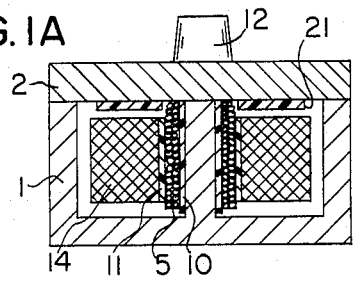
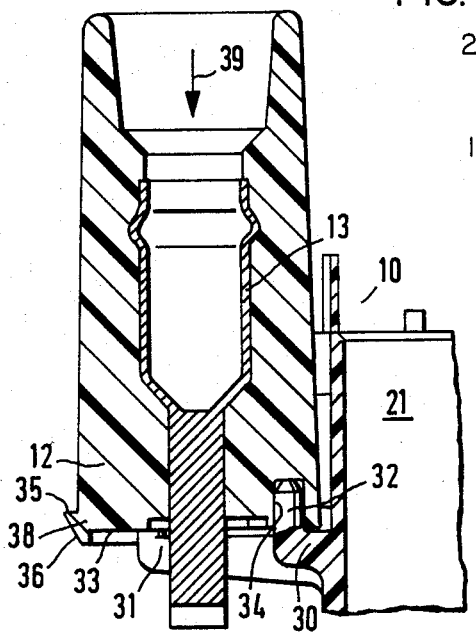
FIG. 2
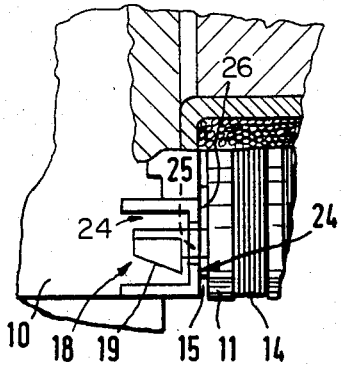
FIG. 3

IGNITION COIL CONSTRUCTION FOR ENGINE IGNITION SYSTEM

This invention concerns the construction of an ignition coil for an internal combustion engine and more particularly, an ignition coil assembly or pre-assembly particularly suitable for embedding in a solid dielectric cst therearound by injection molding.

Because of the high voltages and the electric breakdown possibilities where there are void spaces occupied by air, ignition coil structures are commonly embedded in a solid dielectric provided by a pressure-casting process. For the molding step two kinds of molds are used, reusable and single-use (dedicated). When reusable molds are used, the elements of the ignition coil structure are individually contact-connected and then flooded with the molten dielectric. The connection operation requires the constitution of the reusable mold in at least two parts.

Modern ignition coils are also manufactured with the use of single-use molds which are pot-like shaped and made in one piece of insulating material. The integral character of this casing does not permit the above-mentioned individual connection or contacting of the elements in the single-use mold because of insufficient accessability.

THE INVENTION

It is an object of the present invention to provide a preassembled and contact-interconnected construction which can be inserted in a single-use mold and fully embedded in a casting resin by injection molding. Briefly, the elements of the preassembly, consisting at least of a primary coil body and a secondary coil body are constituted so that they can be snapped together in a manner making and maintaining the necessary electrical contacts. It is particularly desirable for the purpose of snapping the primary and secondary coil bodies together to provide first and second studs, each with a spreading tab extending from an end face of the secondary coil body and to provide the primary coil body with first and second flanges each having a perforation so that the studs may snap into the perforation and the tabs catch behind the flanges. It is also desirable to have, in addition to the studs just mentioned, two protrusions on the same face of the secondary coil body for spacing the two coil bodies in their operating position. The invention has the advantage that the pre-assembly so provided is readily embedded in dielectric by injection molding in a single-use mold and the injection tools for the two coil bodies to be fitted together require no supplementary lateral members for pushing the components together.

The two coil bodies are made of thermoplastic synthetic resin. The high voltage conditions require that the connection mounting or support be supplied with embedding in insulation material of permanently high resistance to leakage current with respect to the neighboring elements, in particular for the connection to the high voltage terminal of the secondary coil. For this purpose the connector for the secondary coil is disposed in a separate connection shell or dome which is snapped onto the primary coil body. Special provisions can also be provided for effecting the snapping and centering of aforesaid connection shell to the primary coil body by simple means. The shape of the connector halves for the connections of the primary coil to the battery and the interruptor are determined by the type of connector desired. A particular type can be used that requires no changes of the injection molding tools for the primary coil body and which permits different types of connector halves to be accepted by the separately manufactured connector body for the pre-assembly.

Making the contacts to the two wire ends of the secondary coil was heretofore accomplished by means of a relatively complicated punched and drawn part on the secondary coil body. In accordance with the invention a clip of simple constitution can be utilized instead. It is useful for a protrusion to be provided on the end face of the secondary coil body and a cavity in the contact part while a rib extends from the end face of the coil body on which several windings of the wire end of the secondary coil winding can be put before the wire end is wound on a projection of the contact part and soldered thereto. This simplifies the winding and the soldering steps.

THE DRAWINGS

The invention is further described by way of illustrative example with reference to the annexed drawings, in which:

FIG. 1 is a top view of a pre-assembled ignition coil construction without iron core and without the embedding dielectric material;

FIG. 1A is a schematic cross-section on a reduced scale, along the line IA—IA of FIG. 1, shown with the iron core in place;

FIG. 2 is a cross-section of the terminal holder 12 of FIG. 1 and its mounting, along the line II—II of FIG. 1;

fIG. 3 is a side view rotated 90° counterclockwise and partly in section, looking in the direction shown by the arrows III of FIG. 1, showing the detail of a location where the two coil bodies are snapped together;

DESCRIPTION OF THE ILLUSTRATED EMBODIMENTS

Figure 4:
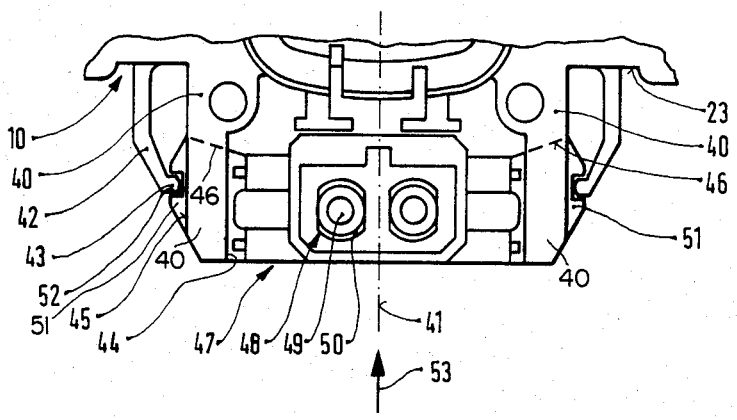
FIG. 4 is a top view of the portion of the primary coil body with a connector plug casing snapped into place thereon.

FIGS. 1 to 3 show a pre-assembled construction of the operating parts of an ignition coil for the ignition system of an internal combustion engine. This pre-assembled unit consists of a primary coil body 10, a secondary coil body 11 having a secondary winding 14, part of which is visible, and a high voltage terminal body 12, in which a connector socket 13 for the secondary coil winding 14 is fixed by having an insulating shell injection molded around it. The two coil bodies 10 and 11 and the h.v. terminal body 12 are fitted together by snap connections.

The shape of the secondary coil body 11 is essentially that of a hollow cylinder of which the axis is shown at 16. The coil body 11 is made of a thermoplastic resin. Two studs 18 extend out of the end face 15 of the coil body 11, each having a catch body 19 with a somewhat wedge-shaped insertion nose. From the same side 15 of the secondary coil body 11 two spacer protrusions 17 also extend. The two protrusions 17 are located diametrically opposite each other with reference to the axis 16 of the secondary coil 11 and the same is true of the two studs 18. The h.v. terminal body 12 is made of polyester resin.

The primary coil body 10 is made of thermoplastic resin, in this case in the shape of a T of which the middle hollow leg portion 10 accepts the middle section of an E-shaped iron core portion 1 shown in FIG. 1A, for which a yoke 2 is fitted into the cross piece 21 of the T-shaped primary coil body 10.

A flange 24 extends away from each longitudinal side 22,23 of the cross piece 21 of the primary coil body 10. Each flange 24 is provided with a perforation 25 which corresponds to one of the studs 18 of the secondary coil body 11. The snap-in connection between the primary coil body 10 and secondary coil body 11 is produced (FIG. 1 and FIG. 3) by inserting the studs 18 into the respective perforations 25 so that the catch heads 19 of the studs 18 grip the flanges 24 from behind. At the same time each of the protrusions 17 of the secondary coil body 11 are against the under side 26 of the primary coil body 10, so that the two coil bodies 10 and 11 are spaced apart in their snapped-in condition. Neither the snap connections nor the spacing protrusions show in FIG. 1A because FIG. 1A is a section along the chain-dotted center line drawn vertically in FIG. 1.

First and second clip arms 27 extend away from one longitudinal side 22 of the primary coil body 10, each having a resilient tongue 28 equipped with a guide baffle 29. Three injection molded arms 30, 31*a* and 31*b* operating together as a support and each carrying pin 32 near its end which is directed upwardly and parallel to the axis 16. All five arms are integral with the body 10.

In the bottom of the cylindrical terminal body 12 are three closed-end holes 34 in an arrangement corresponding to the location of the pins 32. An annular ridge 38 of the terminal holder 12 provides a shoulder 35 equipped with a conically-shaped rim 36. The snapping-in of the terminal body 12 on the primary coil body 10 is produced by bringing the terminal body in the direction of the arrow 39 so that its conical rim 36 pushes against both spring tongues 28 and pushes them laterally away so that finally the shoulders 35 support themselves behind the spring tongues 28.

On the opposite side of the T cross-piece 21 from the h.v. terminal body 12 there extend holding arms 8 and 9 for the primary coil terminal pins 6 and 7. These pins extend away from arms 8 and 9 parallel to the axis 16 in the same direction as the open top of the h.v. terminal body 12.

The component assembly produced by snapping together and by contact engagement is finally introduced into a single-use mold made of insulating material which is not shown in the drawing and all the empty space remaining is filled with a casting resin.

FIG. 4 shows a modification of the structure of FIGS. 1–3 in which the primary coil connectors are held on a separate body that snaps onto the primary coil body 10. The portion of structure shown in FIG. 4 has mirror symmetry about the plane 41 which is perpendicular to the plane of the drawing. From the longitudinal side 23 there extend, on opposite sides of the plane of symmetry 41, two integral spring arms 42 that project at right angles and have tip portions directed more towards the plane of symmetry, each ending in a catch tip 43 directed towards the plane of symmetry 41. On each side of the plane of symmetry there is also a carrier part 40 having a slot 44 running in a plane parallel to the plane of the drawing and cut out in the longitudinal direction all the way to the outer side 45 away from the mid-plane 41. A shoulder 46 forms the inner boundary of the slot 44. The two spring arms 42 and the two slots 44 are disposed in a plane at right angles to the axis 16 of FIG. 1.

A plug casing body 47 made of thermoplastic resin is likewise disposed essentially symmetrically to the plane 41. Each symmetrical half has an opening 48 stepped in diameter which receives a connector-half in the form of a plug connection 50 which is cast into place with a casting material mass 49. The end section of each symmetrical half is provided with a fin 51 having a notch 52.

The attachment of the plug casing 47 to the primary coil body 10 is also produced, as shown, by a snap attachment. As the connector casing 47 is pushed in the direction of the arrow 53 the guide fins 51 are pushed into the slot 44 until they abutt on the shoulders 46. In this operating position the catch tips 43 of the spring arms 42 snap into the notches 52.

Figure 5:
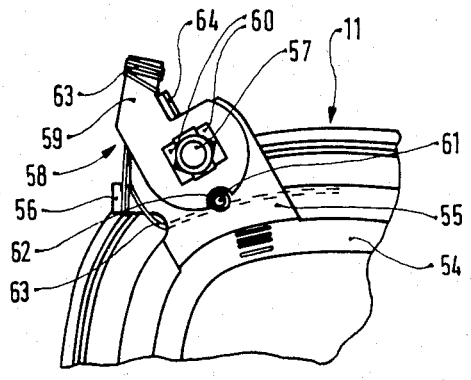
FIG. 5 is a top view of a contact part fitted onto the secondary coil body.

FIG. 5 shows the portion of the secondary coil body 11 from which a plate 55 extends outwardly, the view being essentially of the face 54 of the coil body facing towards the top of the ignition coil unit. The plate 55 has a laterally projecting rib 56 and a raised portion 57 as well as a hump 61, both of which are constituted more or less as pins or studs and are disposed parallel to the axis 16 shown in FIG. 1.

A contact part 58 produced of sheet metal has a projection 59 extending radially with reference to the axis 16 and two spring tabs 60 disposed opposite to each other and notched out of the contact part 58. When these are pushed onto the raised portion 57 the two spring tabs 60 act as barbs and thus secure the operating position of the contact part 58 on the plate 55. The hump 61 then penetrates into a cut-out 62 of the contact part 58, so that the disposition of the latter with respect to the secondary coil body 11 is fixed.

The wire end 63 of the secondary winding that is not visible in the drawing, after the winding process is completed, is wound with several turns about the rib 56 and thereafter likewise in several turns around the projections 59 and finally permanently connected to the latter by welding or soldering. A knife contact 64 is bent up from the contact part 58 towards the top of the ignition coil unit.

Figure 6:
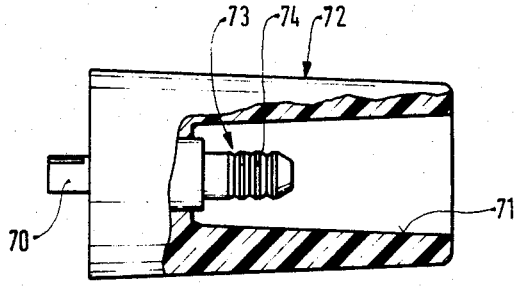
FIG. 6 is a side view, partly in section of a modified terminal holder for fitting onto a portion of the contact part shown in FIG. 5.

The connection plug shown in FIG. 6 is constituted with a contact pin 73 is embedded inside the connection shell 72 by means of a casting material not particularly shown. The pin 73 has a connection portion 74 extending into a cavity 71 of the connection shell 72 and at its other end has a forked portion 70. When the connection shell 72 is snap-connected onto the primary coil body 10 (FIG. 1) the forked end piece 70 and the knife contact 64 (FIG. 5) automatically fit together and this interfit is then welded or soldered. The connection shell 72 is preferably made of polyester resin.

Although the invention has been described with reference to a particular illustrative embodiment, it will be understood that variations and modifications are possible within the inventive concept.

We claim:

1. Ignition coil structure, suitable for embedding in a cast insulating mass, comprising a primary coil body having a hollow leg carrying a primary coil and an iron core havng a central leg inserted into said hollow leg of said body so as to pass through said primary coil, a secondary coil body carrying a secondary coil and a high voltage terminal holder containing a connector connected to said secondary coil at least said primary coil body and said secondary coil body being held together by a snap connection produced by integral parts of said coil bodies, said integral snap connection parts of said secondary coil body comprising at least first and second studs (18) extending from one end face (15) of said secondary coil body, each having a catch tip (19), and said integral snap connection parts of said primary coil body including at least first and second flanges (24) each having a perforation (25), the snap connection between said bodies being provided by insertion of said studs (18) in said perforations (25) and engagement of said catch tips (19) of said studs (18) behind said flanges (24).

2. Structure according to claim 1, in which two protrusions (17) extend away from said end face (15) of said secondary coil body (11) from which said studs (18) extend, for spacing said primary and secondary coil bodies from each other in their relative operating position.

3. Structure according to claim 2, in which said secondary coil body (18) has a generally hollow-cylinder shape and in which said studs (18) and protrusions (17) extend from said end face (15) of said secondary coil body (11) in a direction parallel to the axis (16) of said secondary coil body (11), said studs (18) being disposed diammetrically oppositely each other, and said protrusions (17) likewise.

4. Structure according to claim 1, in which said high voltage terminal holder is constituted as a separate high voltage connector body (12) which is attached to said primary coil body (10) by a snap connection.

5. Structure according to claim 4, in which said iron core comprises a portion (1) of E-shape, having three legs, and a yoke (2) passing across the ends of said legs and in which said primary coil body has a cross member (21) for seating said core yoke, and in which, further, said high voltage connector body (12) is mechanically snap-connected to said cross member (21).

6. Structure according to claim 5, in which said high voltage connector body (12) is snap-connected to said cross member (21) by means of two resilient arms (27) extending laterally from said cross member (21) and shoulder portions (35) of said high voltage connector body (12) abutting respective portions (29) of said resilient arms (27).

7. Structure according to claim 6, in which said primary coil body is provided with a connector-support part constituted by support arms (30,31*a*,31*b*) extending from said primary coil body and each having a pin (32) in its end portion, and in which said high voltage connector body (12) has three closed-end holes therein disposed for the fitting of said pins (32) of said support arms thereinto, whereby said connector body (12) is centered in its position alongside said primary coil body (10).

8. Structure according to claim 4, in which said primary coil body (10) is made of a thermoplastic resin and said high voltage connector body (12) is made of polyester resin.

9. Structure according to claim 1, in which two connector halves for respectively connecting said primary coil to a battery and to an interruptor of a vehicle ignition system are mounted on a separately manufactured dual connector casing (47) which is attached to said primary coil body (10) by a snap connction.

10. Structure according to claim 9, in which said connector halves (50) are cast in place in said connector casing (47) with a mass (49) of casting material.

11. Structure according to claim 9, in which said connector casing (47) has first and second guide fins (51) at opposite ends thereof, and said primary coil body (10) has a pair of support members (40) provided with slots (44) for insertion of said guide fins (51), and in which said connector casing (47) has first and second cavities (52) and said primary coil body has first and second resilient arms (42) snapped into said cavities from the time said fins (51) of said connector casing (47) become fully inserted in said slots (44).

12. Structure according to claim 11, in which said slots (44) have stop surfaces (46) at their inner ends and said fins (51) of said connector casing (47) bear against said stop surfaces (46) in the snapped-in positions of said casing.

13. Structure according to claim 11, in which said resilient arms (42) of said primary coil body (10) and said slots (44) of said support members (40) extend in a plane at right angles to said axis (16).

14. Structure according to claim 3, in which a raised portion (57) is provided on one end face (54) of said secondary coil body (11) and a metallic contact part (58) is applied thereto and attached thereto by barb features provided in portions of said part, and in which said contact part (58) also has a projection (59), extending outward with reference to said axis (16), on which a wire end (63) of said secondary winding is wrapped around for several turns and connected electrically to said projection (59) of said contact part (58).

15. Structure according to claim 14, in which said barb features of said contact part (58) are constituted by tabs notched out of said contact part (58).

16. Structure according to claim 14, in which a protrusion (61) is provided on the face (54) of said secondary coil body on which said raised portion (57) is located in which said protrusion cooperates with a cut-out (62) of said contact part (58) for positioning the latter and a rib (56) extends outwardly from said face (54) of said secondary coil body on which rib several turns of the wire end (63) of said secondary winding are wrapped before the wire end is wrapped on said projection of said contact part.

17. Structure according to claim 1, in which said high voltage terminal holder comprises a contact pin (73) set in a separately produced connector body (72) and held therein by a cast resin material, said contact pin (73) having a connector end extending into a cavity of said connection body (72) and an end opposite to said connector end extending out of said connector body in forked shape, and in which said secondary coil body has, on one face (54) thereof, a raised portion (57) on which a metallic contact part (58) is attached by barbed features of said contact part, said contact part having a cut-out therein and said secondary coil portion having a protrusion (61) penetrating through said cut-out (62), said contact part (58) further having a knife contact extending towards the open top side of the ignition coil, and in which said forked extremity of said contact pin (73) is fitted over said knife contact portion (64) of said contact pin (58) and is welded thereto at the place of fitting.

* * * * *